US007849709B2

(12) United States Patent
Takada et al.

(10) Patent No.: US 7,849,709 B2
(45) Date of Patent: Dec. 14, 2010

(54) INDOOR UNIT OF AN AIR CONDITIONER

(75) Inventors: Yohei Takada, Kusatsu (JP); Hitoshi Kawashima, Kusatsu (JP); Mikio Ito, Kusatsu (JP); Masaaki Kitazawa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 482 days.

(21) Appl. No.: 11/666,878

(22) PCT Filed: Oct. 19, 2005

(86) PCT No.: PCT/JP2005/019184

§ 371 (c)(1),
(2), (4) Date: May 2, 2007

(87) PCT Pub. No.: WO2006/051673

PCT Pub. Date: May 18, 2006

(65) Prior Publication Data

US 2008/0028784 A1 Feb. 7, 2008

(30) Foreign Application Priority Data

Nov. 12, 2004 (JP) ..... 2004-328890

(51) Int. Cl.
*F25D 17/06* (2006.01)
*F25D 17/00* (2006.01)
*F25D 17/04* (2006.01)

(52) U.S. Cl. ..... 62/426; 62/428; 62/180; 62/186

(58) Field of Classification Search ..... 62/62, 62/426, 428, 180, 186, 526
See application file for complete search history.

(56) References Cited

U.S. PATENT DOCUMENTS

| | | | | |
|---|---|---|---|---|
| 5,564,277 | A * | 10/1996 | Martin | 62/50.3 |
| 2002/0152760 | A1 * | 10/2002 | Okuda et al. | 62/259.2 |
| 2004/0007002 | A1 * | 1/2004 | Asami et al. | 62/186 |
| 2004/0089020 | A1 | 5/2004 | Hong et al. | |

FOREIGN PATENT DOCUMENTS

| | | | |
|---|---|---|---|
| EP | 1 445 548 | A1 | 8/2004 |
| JP | 08-135994 | A | 5/1996 |
| JP | 10-176867 | A | 6/1998 |
| JP | 10-196984 | A | 7/1998 |
| JP | 10-205877 | A | 8/1998 |
| JP | 11-248290 | A | 9/1999 |
| JP | 2000-018699 | A | 1/2000 |
| JP | 2001-082754 | A | 3/2001 |
| JP | 2001-082759 | A | 3/2001 |

OTHER PUBLICATIONS

The extended European Search Report of corresponding European Application No. 05795585.8 dated Mar. 23, 2010.

* cited by examiner

*Primary Examiner*—Thomas E Denion
*Assistant Examiner*—Michael Carton
(74) *Attorney, Agent, or Firm*—Global IP Counselors

(57) ABSTRACT

An indoor unit of an air conditioner includes a cross flow fan and an indoor heat exchanger. The cross flow fan generates a flow of air. The heat exchanger has a two row part and a one row part. The one row part has an area that is smaller than the two row part, and is disposed so that it overlaps one part of the two row part in an air transit direction. Furthermore, during a cooling operation, a refrigerant flows to the two row part before flowing to the one row part.

20 Claims, 7 Drawing Sheets

INDOOR UNIT OF AN AIR CONDITIONER

CROSS-REFERENCE TO RELATED APPLICATIONS

This U.S. National stage application claims priority under 35 U.S.C. §119(a) to Japanese Patent Application No. 2004-328890, filed in Japan on Nov. 12, 2004, the entire contents of which are hereby incorporated herein by reference.

FIELD OF THE INVENTION

The present invention relates to an indoor unit of an air conditioner.

BACKGROUND OF THE INVENTION

An indoor unit of an air conditioner is known that comprises a ventilation fan that generates a flow of air, and a heat exchanger that exchanges heat with the air that passes therethrough, and that conditions air (i.e., cooling and heating) by blowing heat exchanged air into an indoor space; in addition, it is known with such an indoor unit of an air conditioner to provide overlapping heat exchanger layers that have different areas. For example, Japanese Published Unexamined Patent Application No. H10-205877 recited below discloses an auxiliary heat exchanger that has a dimension smaller than the width dimension of a heat exchanger and that is provided so that it overlaps part of that heat exchanger.

SUMMARY OF THE INVENTION

Problems Solved By the Invention

Because heat exchanger layers that have different areas are overlapped in the heat exchanger mentioned above, a portion is created wherein the thickness of the layers in the airflow direction varies. With regard to the abovementioned Japanese Published Unexamined Patent Application No. H10-205877, the portion of the heat exchanger where it is not overlapped by the auxiliary heat exchanger is thinner in the air transit direction than the portion where it is overlapped by the auxiliary heat exchanger, and therefore the portion that contacts the air that passes through is small. Consequently, there is a risk that the heat of the air that passes through the portion where the auxiliary heat exchanger does not overlap will not be sufficiently exchanged. Particularly during cooling operation, when the refrigerant that has already been heat exchanged to a certain extent transitions to a state wherein it has a high gas phase ratio and then flows to the portion where the auxiliary heat exchanger does not overlap, there is a high risk that insufficiently heat exchanged air will flow.

It is an object of the present invention to suppress the generation of condensation in a ventilation fan in an indoor unit of an air conditioner that is provided with a heat exchanger wherein heat exchanger layers of different areas overlap.

Means for Solving the Problems

An indoor unit of an air conditioner according to the first aspect of the invention comprises a ventilation fan and a heat exchanger. The ventilation fan generates a flow of air. The heat exchanger comprises a first heat exchanger layer and a second heat exchanger layer. The second heat exchanger layer has an area that is smaller than the first heat exchanger layer and is disposed so that it overlaps one part of the first heat exchanger layer in the air transit direction. Furthermore, during cooling operation, a refrigerant flows to the first heat exchanger layer before flowing to the second heat exchanger layer.

With the indoor unit of the present air conditioner, during cooling operation, the refrigerant flows to the first heat exchanger layer before flowing to the second heat exchanger layer, which makes it possible to flow refrigerant that has a relatively high liquid phase ratio to the first heat exchanger layer. Consequently, it is possible to sufficiently exchange heat in the portion of the second heat exchanger layer that does not overlap the first heat exchanger layer. Thereby, with the indoor unit of the present air conditioner, it is possible to suppress the occurrence of condensation in the ventilation fan.

An indoor unit of an air conditioner according to the second aspect of the invention is an indoor unit of an air conditioner according to the first aspect of the invention, wherein the second heat exchanger layer has a shape that is shorter than the first heat exchanger layer in the longitudinal direction of the first heat exchanger layer.

With the indoor unit of the present air conditioner, a portion is created wherein one part of the first heat exchanger layer in the longitudinal direction is not overlapped by the second heat exchanger layer. However, by flowing the refrigerant to the first heat exchanger layer before flowing to the second heat exchanger layer during cooling operation, it is possible to flow refrigerant with a relatively high liquid phase ratio even in this portion, and to sufficiently exchange heat.

An indoor unit of an air conditioner according to the third aspect of the invention is an indoor unit of an air conditioner according to the first or second aspect of the invention, wherein the first heat exchanger layer is positioned on the side closer to the ventilation fan than the second heat exchanger layer.

Conventionally, if a heat exchanger layer that has a large area is positioned closer to the ventilation fan than a heat exchanger layer that has a small area, then it is often the case that, during cooling operation, the refrigerant will flow from the smaller heat exchanger layer that is positioned further from the ventilation fan. In such a case, there is a high risk that insufficiently heat exchanged air will flow and that condensation will occur in the ventilation fan, as discussed above. However, with the indoor unit of the present air conditioner, the refrigerant flows from the first heat exchanger layer that is positioned near the ventilation fan, which is the reverse of the conventional case. Thereby, with the indoor unit of the present air conditioner, it is possible to suppress the occurrence of condensation in the ventilation fan.

An indoor unit of an air conditioner according to the fourth aspect of the invention is an indoor unit of an air conditioner according to any one aspect of the first through third aspects of the invention, wherein the second heat exchanger layer constitutes an outermost layer of the heat exchanger.

With the indoor unit of the present air conditioner, the second heat exchanger layer that has an area that is smaller than that of the first heat exchanger layer constitutes the outermost layer of the heat exchanger, and the heat exchanger consequently has a shape wherein one part of its outermost layer is truncated. Consequently, the portion where one part of the outermost layer is truncated can be used as space to dispose other components.

An indoor unit of an air conditioner according to the fifth aspect of the invention is an indoor unit of an air conditioner according to the fourth aspect of the invention, wherein the first heat exchanger layer constitutes an innermost layer of the heat exchanger.

With the indoor unit of the present air conditioner, the first heat exchanger layer constitutes the innermost layer of the heat exchanger, and there is consequently a high risk that the air that passes through the first heat exchanger layer will reach the vicinity of the ventilation fan without its heat being further exchanged. Accordingly, by flowing the refrigerant to the first heat exchanger layer before flowing to the second heat exchanger layer, the present invention is particularly useful in suppressing the flow of insufficiently heat exchanged air.

An indoor unit of an air conditioner according to the sixth aspect of the invention is an indoor unit of an air conditioner according to any one aspect of the first through fifth aspects of the invention, further comprising a prescribed component. The prescribed component opposes one part of the first heat exchanger layer that is not overlapped by the second heat exchanger layer, and is disposed in a space that is positioned to the side of the second heat exchanger layer.

With the indoor unit of the present air conditioner, a prescribed component is disposed so that it opposes one part of the first heat exchanger layer that is not overlapped by the second heat exchanger layer, and is disposed in the space that is positioned to the side of the second heat exchanger layer. Namely, a structure is disposed in the space formed by the nonexistence of the second heat exchanger layer. Thereby, with the indoor unit of the present air conditioner, it is possible to reduce the size of the external form.

EFFECTS OF THE INVENTION

With an indoor unit of the air conditioner according to the first aspect of the invention, it is possible to flow refrigerant with a relatively high liquid phase ratio to the first heat exchanger layer during cooling operation, and it is consequently possible to suppress the occurrence of condensation in the ventilation fan.

With an indoor unit of the air conditioner according to the second aspect of the invention, a portion is created wherein one part of the first heat exchanger layer in the longitudinal direction is not overlapped by the second heat exchanger layer, but it is possible to flow refrigerant with a relatively high liquid phase ratio even in this portion, and to sufficiently exchange heat.

With an indoor unit of the air conditioner according to the third aspect of the invention, the refrigerant flows from the first heat exchanger layer that is positioned near the ventilation fan, which is the reverse of the conventional case, and it is consequently possible to suppress the occurrence of condensation in the ventilation fan.

With an indoor unit of the air conditioner according to the fourth aspect of the invention, a portion wherein one part of the outermost layer of the heat exchanger is truncated can be used as a space for disposing other components.

With an indoor unit of the air conditioner according to the fifth aspect of the invention, the refrigerant flows to the first heat exchanger layer before flowing to the second heat exchanger layer, which makes the present invention particularly useful in suppressing the flow of insufficiently heat exchanged air.

With an indoor unit of the air conditioner according to the sixth aspect of the invention, the size of the external form can be reduced by disposing a structure in a space formed by the nonexistence of the second heat exchanger layer.

DETAILED DESCRIPTION OF THE PREFERRED EMBODIMENTS

Air Conditioner Configuration

The following explains an air conditioner 1 that comprises an indoor unit 2 according to one embodiment of the present invention, referencing FIG. 1 through FIG. 6.

Figure 1:
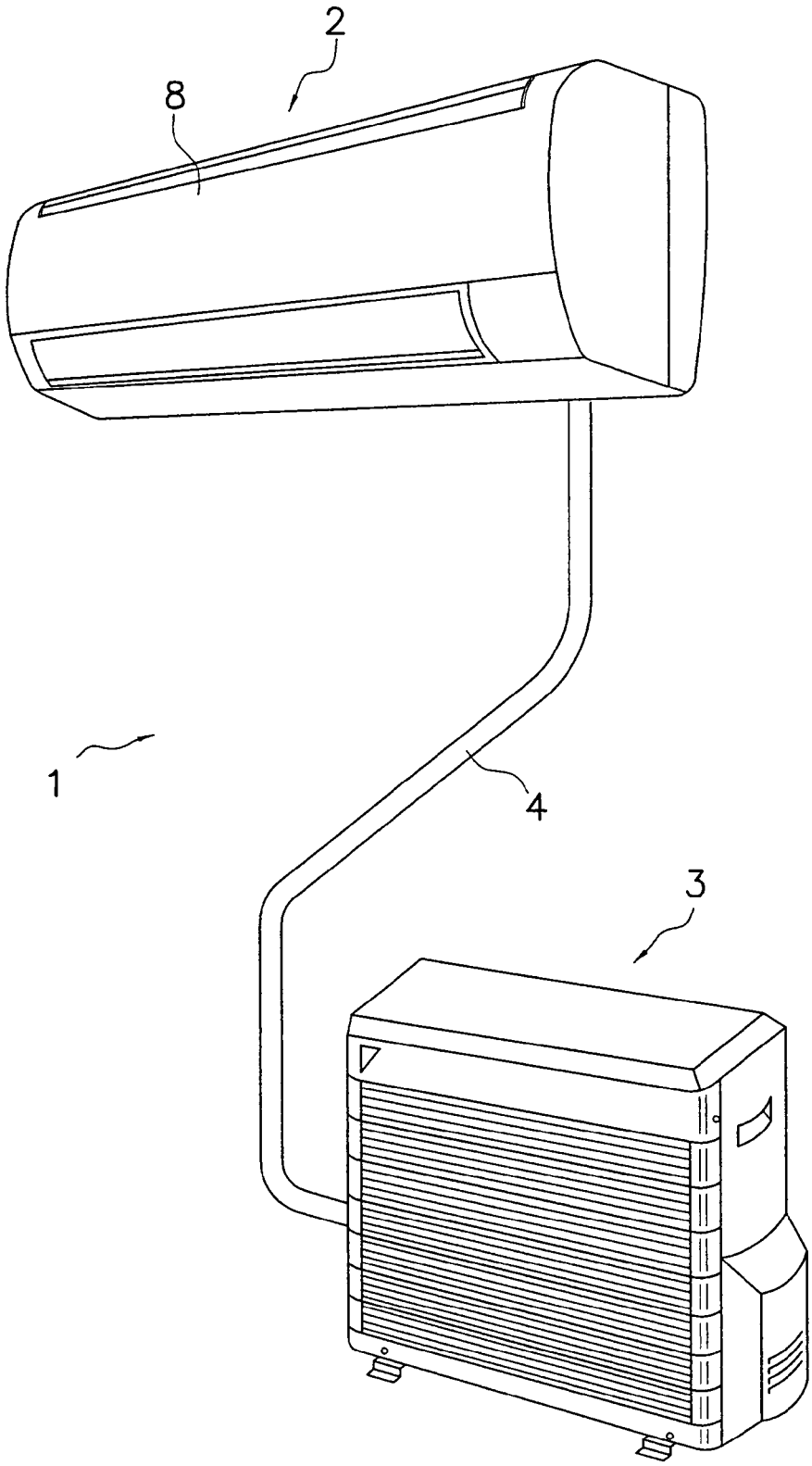
FIG. 1 is an external view of an air conditioner.

As shown in FIG. 1, the air conditioner 1 of the present embodiment is an apparatus for supplying conditioned air to an indoor space, and comprises: the indoor unit 2, which is attached to, for example, a wall surface of the indoor space; and an outdoor unit 3, which is installed in an outdoor space.

An indoor heat exchanger 10, which is discussed later, is housed inside the indoor unit 2, and an outdoor heat exchanger 13, which is discussed later, is housed inside the outdoor unit 3. Furthermore, a refrigerant circuit is configured by connecting the indoor heat exchanger 10 inside the indoor unit 2 with the outdoor heat exchanger 13 inside the outdoor unit 3 via refrigerant piping 4.

Figure 2:
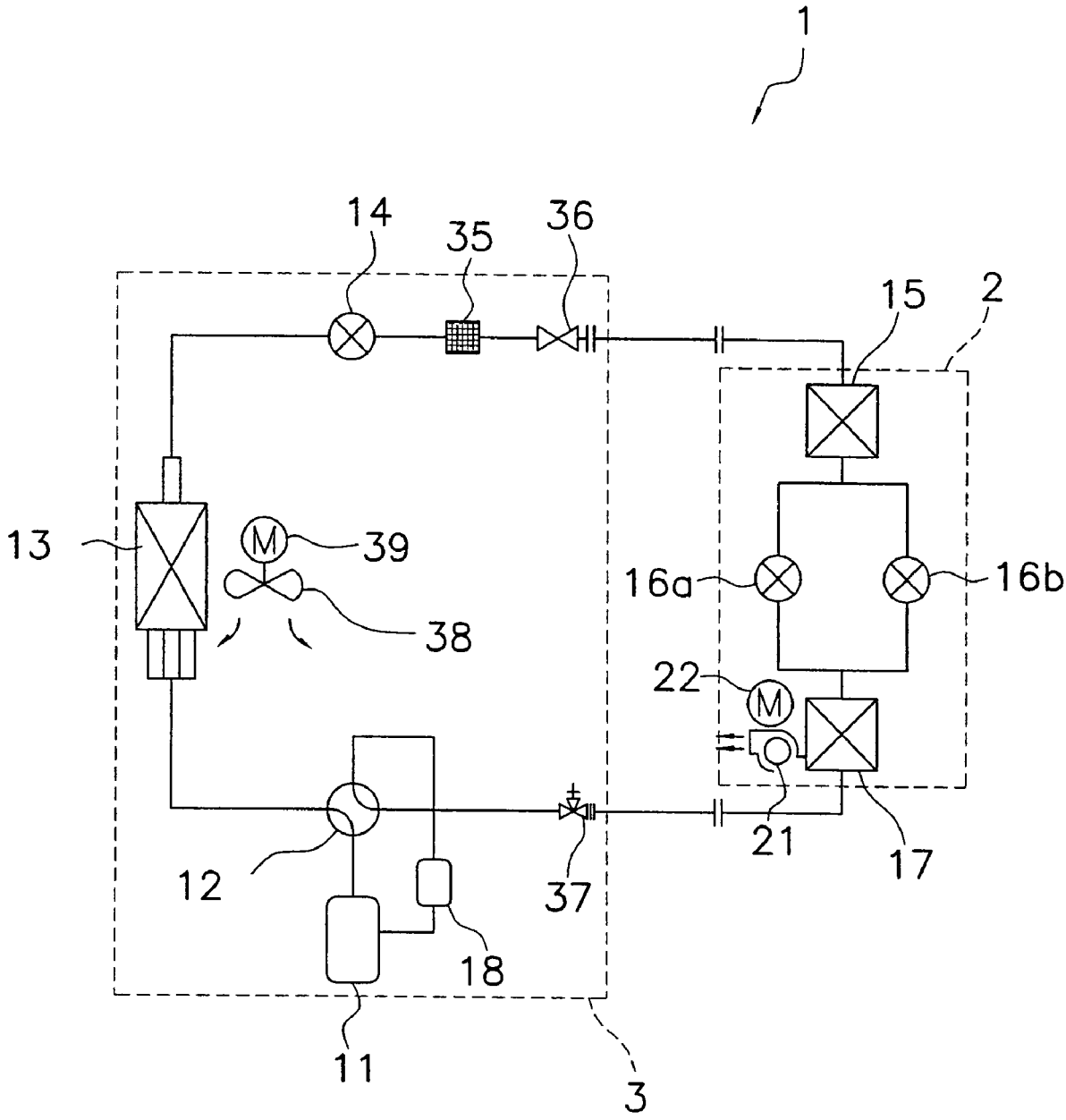
FIG. 2 is a block diagram of a refrigerant circuit.

As shown in FIG. 2, the refrigerant circuit of the air conditioner 1 comprises a compressor 11, a four-way switching valve 12, the outdoor heat exchanger 13, a motor operated expansion valve 14, a first indoor heat exchanger unit 15, a first solenoid valve 16*a*, a second solenoid valve 16*b*, a second indoor heat exchanger unit 17, and an accumulator 18. Furthermore, the first indoor heat exchanger unit 15 and the second indoor heat exchanger unit 17 together constitute the indoor heat exchanger 10 shown in FIG. 3, FIG. 4, and FIG. 5.

The compressor 11 raises the pressure of the refrigerant that flows inside this refrigerant circuit, and pumps it out.

The four-way switching valve 12, which is connected to a discharge side of the compressor 11, changes the passageway of the refrigerant during cooling operation, reheat dehumidification operation, and heating operation. Furthermore, the four-way switching valve 12 shown in FIG. 2 is in the state when cooling operation is performed and when reheat dehumidification operation is performed.

The outdoor heat exchanger 13 is connected to the four-way switching valve 12, and functions as an evaporator during heating operation and as a condenser during cooling operation and reheat dehumidification operation. In addition, the outdoor heat exchanger 13 exchanges heat with the air that an adjacently disposed propeller fan 38 suctions to the inside of the outdoor unit 3.

The motor operated expansion valve 14, which is connected to the outdoor heat exchanger 13, functions as an expansion mechanism that changes the refrigerant's pressure. For example, during cooling operation, the motor operated expansion valve 14 transitions to the closed state and expands the refrigerant in order to make the first indoor heat exchanger unit 15 (discussed later) function as an evaporator. Moreover, during reheat dehumidification operation, the motor operated expansion valve 14 transitions to a fully opened state and does not change the refrigerant's pressure in order to make the first indoor heat exchanger unit 15 function as a condenser.

The first indoor heat exchanger unit 15, which is connected to the motor operated expansion valve 14, functions as an evaporator during cooling operation and as a condenser during heating operation and during reheat dehumidification operation.

The first solenoid valve 16*a* and the second solenoid valve 16*b*, which are disposed between the first indoor heat exchanger unit 15 and the second indoor heat exchanger unit 17 in the refrigerant circuit shown in FIG. 2 so that they are parallel to one another, can control the flow of the refrigerant in the refrigerant circuit. Specifically, the first solenoid valve 16*a* and the second solenoid valve 16*b* are expansion valves that expand the refrigerant that passes therethrough, and can lower the pressure of the refrigerant that flows to the second indoor heat exchanger unit 17 during reheat dehumidification operation.

The second indoor heat exchanger unit 17, which is connected to the first solenoid valve 16*a* and the second solenoid valve 16*b* that are disposed in parallel, functions as an evaporator during reheat dehumidification operation and during cooling operation and as a condenser during heating operation.

The accumulator 18, which is connected to the suction side of the compressor 11, prevents liquid refrigerant from contaminating the compressor 11.

The indoor unit 2 comprises the first indoor heat exchanger unit 15 and the second indoor heat exchanger unit 17, as described above, that exchange heat with the air that contacts them. Furthermore, the indoor unit 2 comprises a cross flow fan 21 (refer to FIG. 2 and FIG. 3) that generates an airflow in order to suck in the indoor air and to exhaust the air conditioned air into the indoor space via the first indoor heat exchanger unit 15 and the second indoor heat exchanger unit 17. An indoor fan motor 22, which is provided inside the indoor unit 2, rotationally drives the cross flow fan 21 about its center axis.

The outdoor unit 3 comprises the compressor 11, the four-way switching valve 12, the accumulator 18, the outdoor heat exchanger 13, and the motor operated expansion valve 14. The motor operated expansion valve 14 is connected to piping 41 via a filter 35 and a liquid shutoff valve 36, and is connected to one end of each of the indoor heat exchanger units 15, 17 of the indoor unit 2 via this piping 41. In addition, the four-way switching valve 12 is connected to piping 42 via a gas shutoff valve 37, and is connected to the other side end of each of the indoor heat exchanger units 15, 17 of the indoor unit 2 via this piping 42. Furthermore, the piping 41, 42 correspond to the refrigerant piping 4 in FIG. 1. In addition, the propeller fan 38 is provided in the outdoor unit 3 in order to suck the air into the outdoor unit 3 and then externally exhaust the air after its heat has been exchanged by the outdoor heat exchanger 13. An outdoor fan motor 39 rotationally drives the propeller fan 38.

Indoor Unit Configuration

Figure 3:
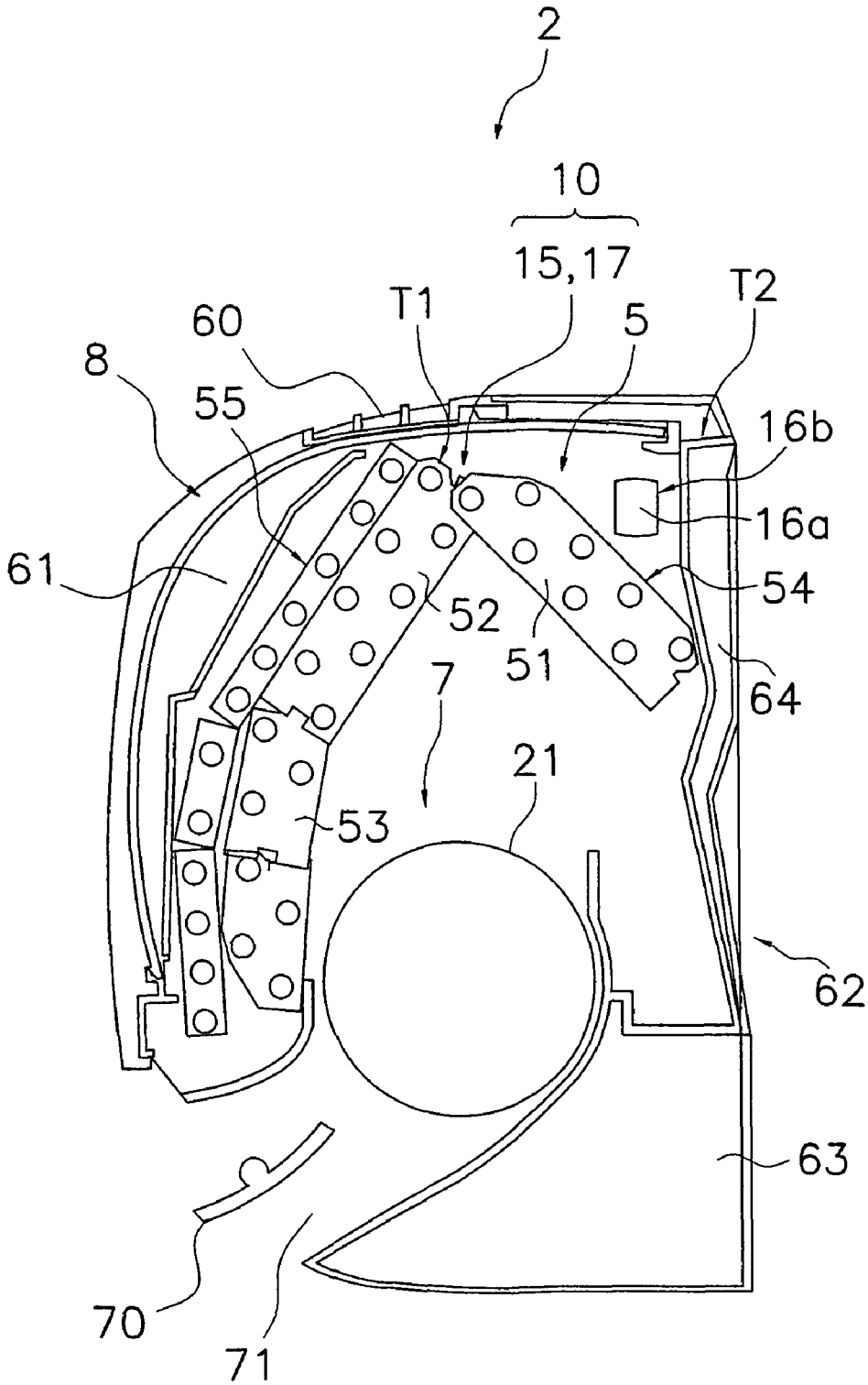
FIG. 3 is a side cross sectional view of an indoor unit.

The indoor unit 2 has a shape that is long in the horizontal direction and in the transverse direction in a front view (refer to FIG. 1). Hereinbelow, among horizontal directions, the direction that is the transverse direction in a front view of the indoor unit 2 is simply called the "transverse direction." As shown in FIG. 3, the indoor unit 2 principally comprises a ventilation mechanism 7 internally housed in the indoor unit 2, an indoor heat exchanger unit 5, the first solenoid valve 16*a*, the second solenoid valve 16*b*, an indoor unit casing 8, and a control unit 90 (refer to FIG. 6).

(Ventilation Mechanism)

The ventilation mechanism 7, which generates the flow of air that enters the inner part of the indoor unit 2 from the indoor space and is blown out once again to the indoor space through the indoor heat exchanger 10, comprises the cross flow fan 21 and the indoor fan motor 22 and the like (refer to FIG. 2). The cross flow fan 21 has a tubular shape that is long in the transverse direction, and is disposed so that its center axis is parallel to the transverse direction. The indoor fan motor 22 is disposed to the side of the cross flow fan 21 and rotationally drives such. The ventilation mechanism 7 is supported by a bottom frame 62, which is discussed later.

(Indoor Heat Exchanger Unit)

Figure 5:
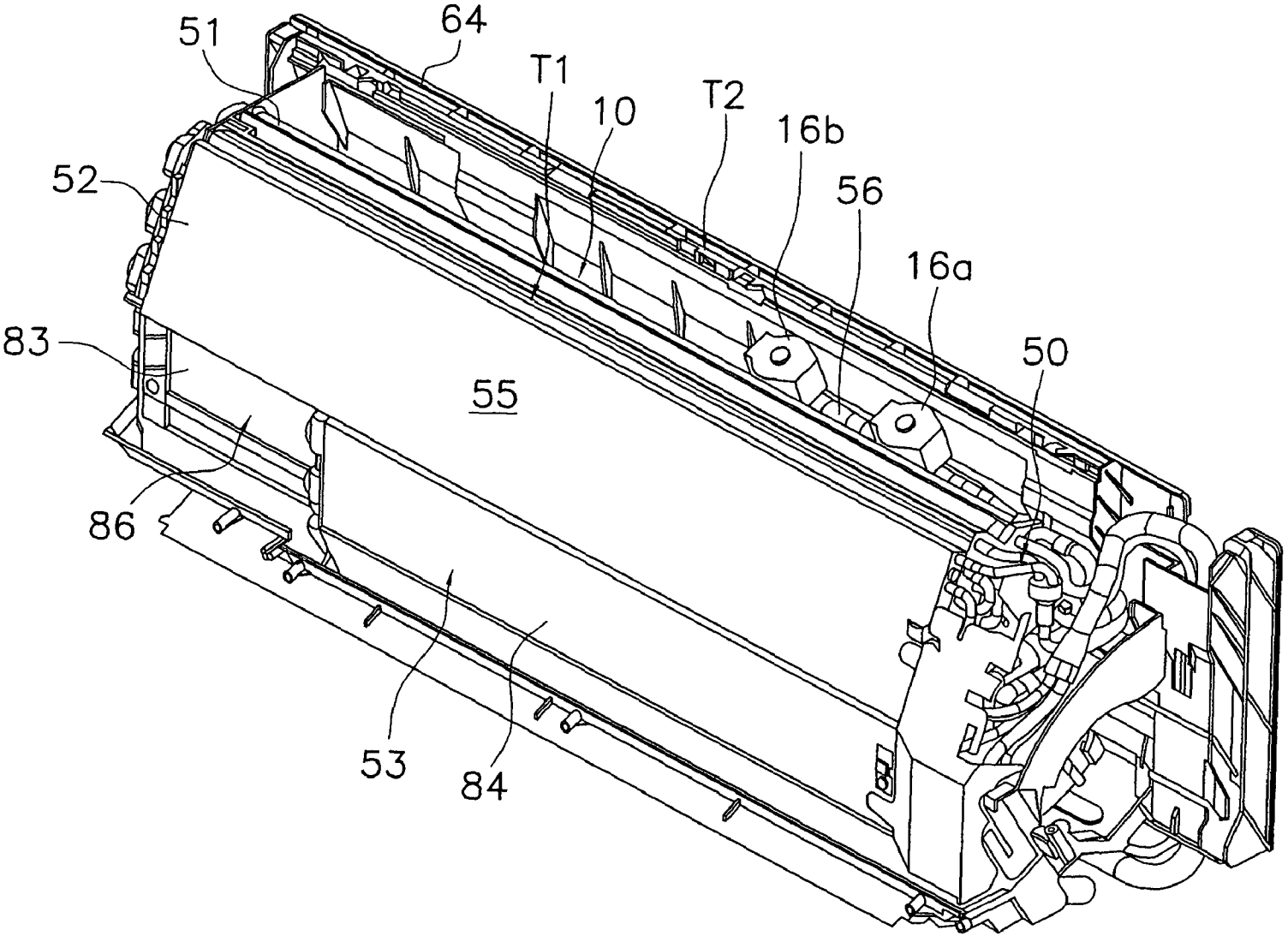
FIG. 5 is an external oblique view of an indoor heat exchanger unit.

As shown in FIG. 3, the indoor heat exchanger unit 5 comprises the indoor heat exchanger 10 and auxiliary piping 50 and the like (refer to FIG. 5). The indoor heat exchanger 10 comprises the first indoor heat exchanger unit 15 and the second indoor heat exchanger unit 17, which were discussed above. Furthermore, the first indoor heat exchanger unit 15 and the second indoor heat exchanger unit 17, which are included in the refrigerant circuit in FIG. 2, are independently configured; however, in the present embodiment, one portion of a single heat exchanger corresponds to the first indoor heat exchanger unit 15, and the portion of that single heat exchanger that excludes that one portion corresponds to the second indoor heat exchanger unit 17.

As shown in FIG. 5, the indoor heat exchanger 10 has a shape that is long in the transverse direction, and is disposed parallel to the longitudinal direction of the indoor unit casing 8 (refer to FIG. 1). As shown in FIG. 3, the indoor heat exchanger 10 comprises a combination of a rear part 51, a first front part 52, and a second front part 53.

The rear part 51 constitutes a rear side upper part of the indoor heat exchanger 10 and has a rectangular plate shape. The rear part 51 is inclined so that its upper end is positioned to the front of its lower end. In addition, the rear part 51 constitutes a two row heat exchanger, wherein two rows of heat transfer pipes are disposed in the air transit direction.

Figure 4:
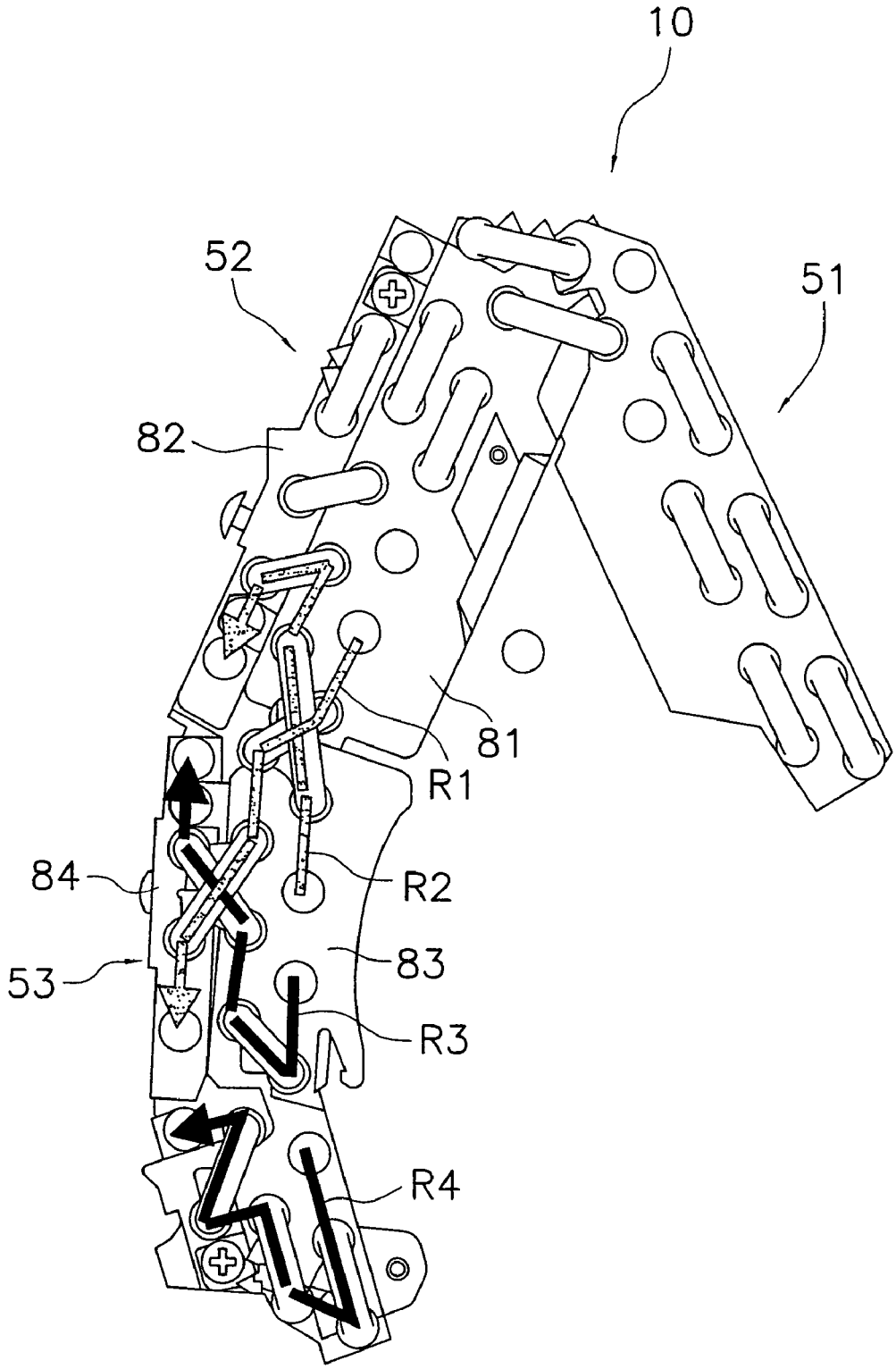
FIG. 4 shows the regular route of the flow of the refrigerant in an indoor heat exchanger.

The first front part 52 constitutes the front side upper part of the indoor heat exchanger 10 and, like the rear part 51, has a rectangular shape. The first front part 52 is inclined so that its upper end is positioned to the rear side of the lower end and is proximate to or joined with the upper end of the rear part 51. Namely, the first front part 52 and the rear part 51 are combined so that they form an inverted V shape in a side view. In addition, as shown in FIG. 4, the first front part 52 comprises a two row part 81 and a one row part 82. The two row part 81 is a portion wherein a plurality of heat transfer pipes, each of which perpendicularly passes through a plurality of fins that are disposed parallel to one another, are disposed so that they are divided into two rows. The one row part 82 is a portion wherein a plurality of heat transfer pipes, each of which perpendicularly passes through a plurality of fins that are disposed parallel to one another, are disposed in one row. Furthermore, each row of multiple heat transfer pipes is lined up along a rear inclined surface 54, which is discussed later. The two row part 81 is positioned on the innermost side of the indoor heat exchanger 10, i.e., on the side that is closer to the cross flow fan 21 (refer to FIG. 3), and constitutes one part of the innermost layer of the indoor heat exchanger 10. The one row part 82 is positioned on the outermost side of the indoor heat exchanger 10, i.e., on the side that is farther from the cross flow fan 21, and constitutes one part of the outermost layer of the indoor heat exchanger 10. The one row part 82 is provided so that it overlaps the two row part 81 in the air transit direction, and is adjacent to the two row part 81 on its outer side. In addition, the one row part 82 and the two row part 81 have the same length in the transverse direction, and are disposed so that both side end parts of the one row part 82 and both side end parts of the two row part 81 are aligned. In addition, the one row part 82 and the two row part 81 have substantially the same vertical direction dimension, and are disposed so that their upper end parts and lower end parts are aligned. Thus, the first front part 52 constitutes a three row heat exchanger wherein a plurality of heat transfer pipes are divided into three rows and lined up in the air transit direction, i.e., in a direction perpendicular to the transverse direction.

The second front part 53 constitutes the front side lower part of the indoor heat exchanger 10, and, like the other portion, has a rectangular plate shape. The second front part 53 is disposed below the first front part 52, and the lower end of the first front part 52 is proximate to or joined with the upper end of the second front part 53. In addition, like the first front part 52, the second front part 53 has a two row part 83 and a one row part 84. The two row part 83 is a portion wherein a plurality of heat transfer pipes, each of which perpendicularly passes through a plurality of fins that are disposed parallel to one another, are disposed so that they are divided into two rows. The one row part 84 is a portion wherein a plurality of heat transfer pipes, each of which perpendicularly passes through a plurality of fins that are disposed parallel to one another, is disposed in one row. Furthermore, each row of multiple heat transfer pipes is lined up along a front inclined surface 55, which is discussed later. The two row part 83 is positioned on the innermost side of the indoor heat exchanger 10, i.e., on the side closer to the cross flow fan 21, and constitutes one part of the innermost layer of the indoor heat exchanger 10. The one row part 84 is positioned on the outermost side of the indoor heat exchanger 10, i.e., on the side farther from the cross flow fan 21, and constitutes one part of the outermost layer of the indoor heat exchanger 10. The one row part 84 is provided so that it overlaps one part of the two row part 83 in the air transit direction, and is adjacent to the two row part 83 on its outer side. In addition, the first row part 84 and the second row part 83 have substantially the same vertical direction dimension; however, the transverse direction dimension of the one row part 84 is smaller than that of the two row part 83. As shown in FIG. 5, one side end of the one row part 84 in the transverse direction is disposed so that it is aligned with one side end of the two row part 83 in the transverse direction, but the other side end of the one row part 84 in the transverse direction is not aligned with the other side end of the two row part 83 in the transverse direction, and the one row part 84 has a shape that is shorter in the transverse direction than the two row part 83. Specifically, the right side end of the one row part 84 in a front view is disposed so that it is aligned with the right side end of the two row part 83 in the transverse direction, but the left side end of the one row part 84 is not aligned with the left side end of the two row part 83. Accordingly, the second front part 53 is divided into a three row heat exchanger unit, wherein a plurality of heat transfer pipes are divided into three rows and lined up in the air transit direction, and a two row heat exchanger unit, wherein a plurality of heat transfer pipes are divided into two rows (one row fewer than that of the three row heat exchanger unit) and lined up in the air transit direction, and the two row heat exchanger unit is positioned in the vicinity of the left end of the second front part 53. Accordingly, the area of the one row part 84 is smaller than that of the two row part 83 and substantially the entire portion of the one row part 84 overlaps the second row part 83; however, one part of the two row part 83 is not overlapped by the one row part 84.

Because the indoor heat exchanger 10 is configured so that the rear part 51, the first front part 52, and the second front part 53 are combined as described above, it has a shape that is bent so that it protrudes upward in a side view. The portion on the rear side of a vertex T1 of the bend of the indoor heat exchanger 10 forms an inclined surface (hereinbelow, called the "rear inclined surface 54") that is inclined so that its upper end is positioned frontward and its lower end is positioned rearward. The rear inclined surface 54 is one part of the rear part 51. The portion on the front side of the vertex T1 of the bend of the indoor heat exchanger 10 forms an inclined surface (hereinbelow, called the "front inclined surface 55") that is inclined so that its upper end is rearward and its lower end is frontward. The front inclined surface 55 is one part of the first front part 52. The joint portion between the front inclined surface 55 and the rear inclined surface 54 forms the vertex T1 of the abovementioned bend. The indoor heat exchanger 10 has a shape that is long in the transverse direction, and the front inclined surface 55 and the rear inclined surface 54 each form an inclined, rectangularly shaped flat surface that is long in the transverse direction.

The indoor heat exchanger 10 is disposed so that it opposes the circumferential surface of the cross flow fan 21, and is attached so that it encloses the cross flow fan 21 from the front and above. The first indoor heat exchanger unit 15 and the second indoor heat exchanger unit 17 exchange heat between the refrigerant that passes through the inner part of the heat transfer pipes in the first indoor heat exchanger unit 15 and the second indoor heat exchanger unit 17 and the air that is sucked in by the airflow that is generated by the rotation of the cross flow fan 21. Furthermore, the indoor unit 2 blows the conditioned air out from a blow out port 71 while adjusting the blow out direction by means of a horizontal flap 70.

The auxiliary piping 50 interconnects the plurality of heat transfer pipes that protrude from the side surface of the indoor heat exchanger 10, and interconnects the first indoor heat exchanger unit 15, the second indoor heat exchanger unit 17, and the refrigerant piping 4, etc. Most of the auxiliary piping 50 is provided so that it is complexly bent in a space to the side of the indoor heat exchanger 10, however, as shown in FIG. 5, one part of the auxiliary piping (hereinbelow, called "rear part auxiliary piping 56") passes through a space from the side of the indoor heat exchanger 10 to the rear of the indoor heat exchanger 10, and is connected to the first solenoid valve 16*a* and the second solenoid valve 16*b*. In contrast to the auxiliary piping 50 that is to the side of the indoor heat exchanger 10 and has a complexly bent shape, the rear part auxiliary piping 56 has a comparatively linear shape. The rear part auxiliary piping 56 is provided at the rear of the indoor heat exchanger 10 so that it extends in the transverse direction, and is longer than the length of the space in the transverse direction wherein the auxiliary piping 50 is provided and disposed to the side of the indoor heat exchanger 10. The following explains the regular route of the refrigerant that flows in the indoor heat exchanger 10 via the auxiliary piping 50.

In FIG. 2, the refrigerant that exits the outdoor heat exchanger 13 during cooling operation and during reheat dehumidification operation passes through the motor operated expansion valve 14, passes from the outdoor unit 3 through the piping 41, and flows to the indoor unit 2. The refrigerant that is transported to the indoor unit 2 flows first to the first indoor heat exchanger unit 15 via the auxiliary piping 50 (refer to FIG. 5). At this time, the refrigerant is divided into two routes by the auxiliary piping 50 and flows to the rear part 51 and one part of the first front part 52 (refer to FIG. 3). The refrigerant that exits from the first indoor heat exchanger unit 15 passes through the first solenoid valve 16*a* and the second solenoid valve 16*b*, thereby dividing into two routes, and then flows to the second indoor heat exchanger unit 17. At this time, the refrigerant that passes through the first solenoid valve 16*a* and the second solenoid valve 16*b* is divided into four routes R1-R4 by the auxiliary piping 50, as shown by the arrows in FIG. 4, and flows to the second front part 53 and one part of the first front part 52. At this time, the auxiliary piping 50, which is split four ways, is connected to one part of the plurality of heat transfer pipes that are disposed in the row on the innermost side of the first front part 52 and the second front part 53, and the refrigerant that flows through each of the routes R1-R4 flows through the row of the heat transfer pipes on the innermost side of the first front part 52 and the second front part 53, i.e., the heat transfer pipes of the row on the inner side of the two row parts 81, 83. Next, the refrigerant flows through the heat transfer pipes of the row on the outer sides of the two row parts 81, 83, and, lastly, flows through the heat transfer pipes of the one row parts 82, 84. Thus, the refrigerant is divided into four routes R1-R4, flows through the second front part 53 and one part of the first front part 52 from the inner side to the outer side, and is then exhausted from the indoor heat exchanger 10. For example, in the third route R3, the refrigerant flows from the two row part 83 before it flows to the one row part 84 of the second front part 53. The refrigerant that passes through the third route R3 first passes through two heat transfer pipes that are included in the row on the inner side of the two row part 83, then passes through two heat transfer pipes that are included in the row on the outer side of the two row part 83, and, lastly, passes through two heat transfer pipes that are included in the one row part 84, after which it is exhausted from the second front part 53. The refrigerant that was divided into four routes R1-R4 and exhausted from the indoor heat exchanger 10 is consolidated by the auxiliary piping 50 and sent to the outdoor unit 3 through the piping 42.

During heating operation, the four way switching valve 12 switches the direction of the flow of refrigerant, which then flows in a direction that is the reverse of that mentioned above.

(Indoor Unit Casing)

As discussed above, the indoor unit casing 8 houses, for example, the indoor heat exchanger unit 5 and the ventilation mechanism 7, and has a box shape that is long in the transverse direction, as shown in FIG. 1. The indoor unit casing 8 is substantially D-shaped in a side view, and has a thin shape wherein its depth direction dimension, i.e., its thickness, is less than its vertical direction dimension, i.e., its height. As shown in FIG. 3, the indoor unit casing 8 comprises a front surface grill 61 and the bottom frame 62.

The front surface grill 61 is configured so that it covers the indoor heat exchanger unit 5 from the front and from above, and forms the contour of the upper surface side and front surface side of the indoor unit 2. An upper surface of the front surface grill 61 is provided with a plurality of openings in a lattice. These openings form a suction port 60, through which the air suctioned from the indoor space into the inner part of the indoor unit casing 8 passes. In addition, the upper surface of the front surface grill 61 is proximate to the vertex T1 of the indoor heat exchanger 10 discussed above.

The bottom frame 62 is configured so that it covers the indoor heat exchanger unit 5 from the rear and below, and constitutes the contour of the bottom surface side and the rear surface side of the indoor unit 2. The bottom frame 62 comprises a bottom frame lower part 63, which constitutes a bottom surface of the indoor unit 2, and a bottom frame rear surface part 64, which constitutes a rear surface of the indoor unit 2. The bottom frame lower part 63 is provided with a space that houses the cross flow fan 21 of the ventilation mechanism 7, and this space is coupled to the blow out port 71, which is provided to the front surface lower part of the bottom frame 62. The bottom frame rear surface part 64 covers the indoor heat exchanger 10 from the rear, and extends in the vertical direction. An upper end T2 of the bottom frame rear surface part 64 is proximate to or in contact with a rear end of an upper surface of the front surface grill 61. In addition, the bottom frame rear surface part 64 is proximate to a lower end of the rear part 51 of the indoor heat exchanger 10.

(First Solenoid Valve and Second Solenoid Valve)

As shown in FIG. 3 and FIG. 5, the first solenoid valve 16*a* and the second solenoid valve 16*b* are disposed between the bottom frame rear surface part 64 and the rear part 51 of the indoor heat exchanger 10 so that they are spaced apart by a distance in the longitudinal direction, i.e., the transverse direction, of the indoor heat exchanger 10 at the rear of the rear part 51. In greater detail, the first solenoid valve 16*a* and the second solenoid valve 16*b* are disposed so that they oppose the vicinity of the upper part of the rear inclined surface 54 of the indoor heat exchanger 10. Namely, the first solenoid valve 16*a* and the second solenoid valve 16*b* are disposed in a wedge shaped space between the rear part 51 of the indoor heat exchanger 10 and the bottom frame rear surface part 64. In addition, the first solenoid valve 16*a* and the second solenoid valve 16*b* are disposed so that their distances from the rear part 51 of the indoor heat exchanger 10 are substantially identical, and so that they are linearly lined up parallel to the transverse direction. Accordingly, the first solenoid valve 16*a* and the second solenoid valve 16*b* are disposed at the same height and are linearly lined up along the longitudinal direction of the indoor heat exchanger 10. In addition, as shown in FIG. 3, the first solenoid valve 16*a* and the second solenoid valve 16*b* are disposed so that they overlap in a side view. Furthermore, the first solenoid valve 16*a* and the second solenoid valve 16*b* are disposed so that they do not top the upper end T2 of the bottom frame rear surface part 64, and are positioned at substantially the same height as the upper end T2 of the bottom frame rear surface part 64.

(Control Unit)

Figure 6:
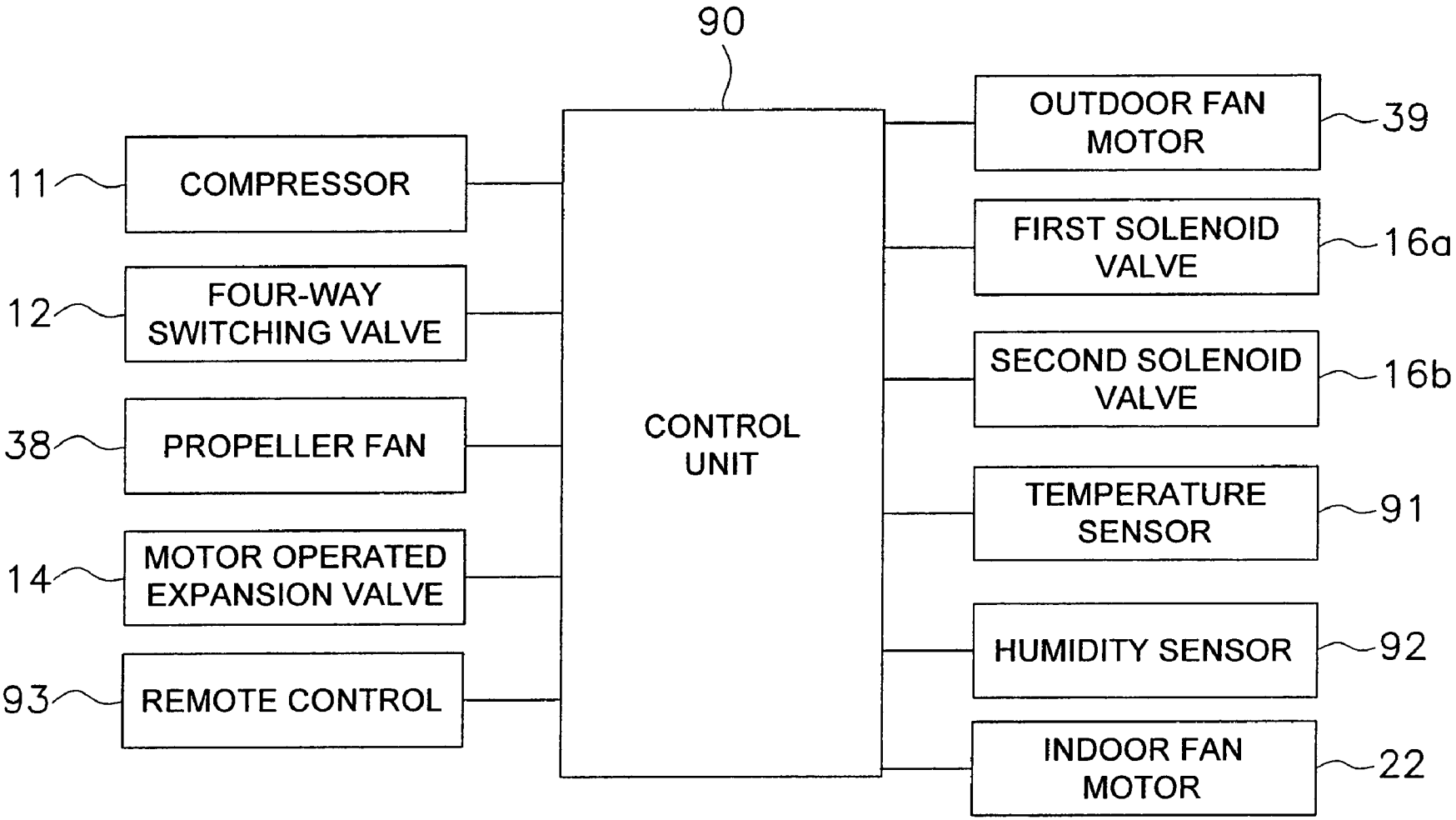
FIG. 6 is a control block diagram.
Figure 7:
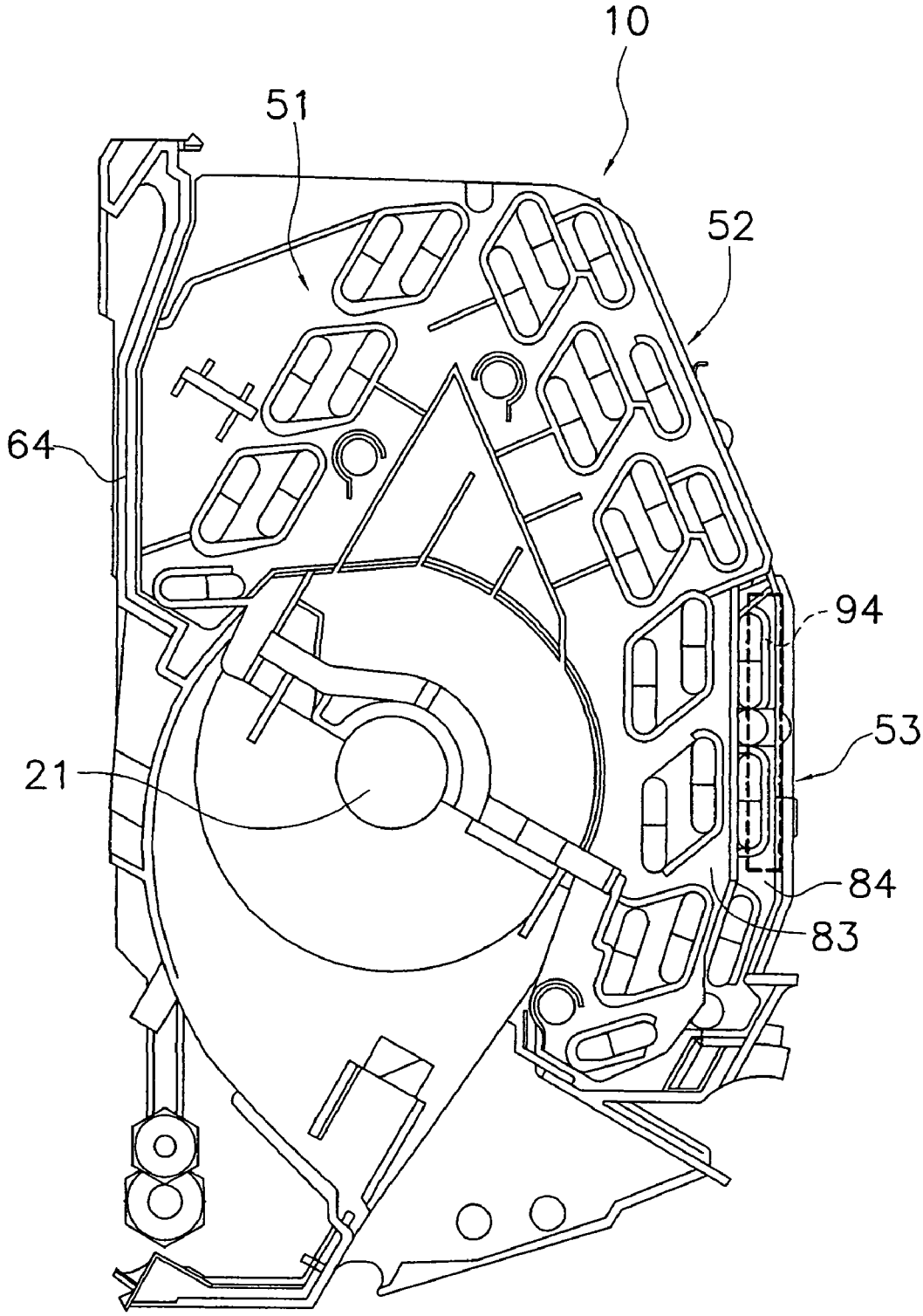
FIG. 7 is a side view of the indoor heat exchanger unit.

The control unit 90 shown in FIG. 6 is provided so that it is split between the indoor unit 2 and the outdoor unit 3, and, in accordance with an instruction from a remote control 93, performs the instructed air conditioning operation. In addition, as shown in FIG. 7, a control circuit board 94, which includes one part of the control unit 90, is installed in a space that is provided to the front of the vicinity of the left end of the second front part 53. Namely, the control circuit board 94 is disposed so that it opposes the one part of the two row part 83 that is not overlapped by the one row part 84 of the second front part 53, and is disposed in the space positioned to the left side of the one row part 84.

The following explains the specific details of the control that is performed by the control unit 90.

Operation During Reheat Dehumidification Operation

In the indoor unit 2 during reheat dehumidification operation, the first indoor heat exchanger unit 15 is made to function as a condenser, and the second indoor heat exchanger unit 17 is made to function as an evaporator. Consequently, the motor operated expansion valve 14 is set to the open state, and one or both of the first solenoid valve 16*a* and the second solenoid valve 16*b* are set to the closed state. Thereby, it is possible to make the first indoor heat exchanger unit 15 function as a condenser and to make all or one part of the second indoor heat exchanger unit 17 function as an evaporator because the refrigerant that flows in the second indoor heat exchanger unit 17 expands and transitions to a low temperature and low pressure liquid refrigerant.

Furthermore, the determination of whether to set one or both of the first solenoid valve 16*a* and the second solenoid valve 16*b* to the closed state is made in accordance with the magnitude of a sensible heat load and a latent heat load of the indoor space. Namely if, for example, the indoor space humidity is high (if the latent heat load is large), then it is necessary to perform a large amount of latent heat processing. Consequently, both the first solenoid valve 16*a* and the second solenoid valve 16*b* are set to the closed state and the entire second indoor heat exchanger unit 17 is made to function as an evaporator so that the entire portion of the second indoor heat exchanger unit 17 can be used as an evaporator. Moreover, if the indoor space humidity is not so high (if the latent heat load is small), then just one part of the second indoor heat exchanger unit 17 can be used as an evaporator. Consequently, just the first solenoid valve 16*a* is set to the closed state.

Thus, differentiating the use of a first state and a second state that is dependent on whether both or just one of the first and second solenoid valves 16*a*, 16*b* is set to the closed state, makes it possible to change the area of the indoor heat exchanger 10 that performs the sensible heat process and the latent heat process in accordance with seasonal and daily changes in the magnitude of the indoor load, which enables more flexible control than that of conventional reheat dehumidification operation.

Furthermore, switching between the first state and the second state may be controlled automatically in accordance with the magnitudes of the sensible heat load and the latent heat load of the indoor space, which are detected by, for example, a temperature sensor 91 and a humidity sensor 92 (refer to FIG. 6) attached t6 the indoor unit 2, or may be performed manually by a user.

Operation During Cooling Operation

With the indoor unit 2 of the present embodiment, the motor operated expansion valve 14 is set to the closed state in order to use both the first indoor heat exchanger unit 15 and the second indoor heat exchanger unit 17 as evaporators during cooling operation. Thereby, the refrigerant that passes through the motor operated expansion valve 14 expands and transitions to a low temperature and low pressure liquid refrigerant, which makes it possible to make both the first indoor heat exchanger unit 15 and the second indoor heat exchanger unit 17 function as evaporators. Furthermore, the first solenoid valve 16*a* and the second solenoid valve 16*b* also transition to the open state at this time.

Here, with the indoor unit 2 that has a reheat dehumidification type refrigerant circuit as in the present embodiment, there is a problem during cooling operation in that the refrigerant in the solenoid valve, which is provided between the first indoor heat exchanger unit 15 and the second indoor heat exchanger unit 17, loses pressure. However, with the indoor unit 2 in the present embodiment, it is possible to reduce the pressure loss of the refrigerant and to avoid a decline in cooling capacity by disposing two solenoids, i.e., the first solenoid valve 16*a* and the second solenoid valve 16*b*, in parallel between the first indoor heat exchanger unit 15 and the second indoor heat exchanger unit 17.

Operation During Heating Operation

With the indoor unit 2 of the present embodiment, the refrigerant flows during heating operation in the direction that is opposite from that during cooling operation. The motor operated expansion valve 14 transitions to the closed state and the first solenoid valve 16*a* and the second solenoid valve 16*b* both transition to the open state. Because the refrigerant that passes through the motor operated expansion valve 14 expands and transitions to a low temperature and low pressure liquid state, the outdoor heat exchanger 13 functions as an evaporator. In addition, the refrigerant that is discharged from the compressor 11 passes through the first indoor heat exchanger unit 15 and the second indoor heat exchanger unit 17, which both function as condensers.

Features of the Present Air Conditioner Indoor Unit (1)

With the indoor unit 2 of the air conditioner 1, the refrigerant that flows through the second indoor heat exchanger unit 17 during cooling operation flows from the inner side to the outer side of the second front part 53, and consequently flows to the two row part 83 of the second front part 53 before it flows to the one row part 84 of the shorter second front part 53. Consequently, refrigerant that has a relatively high liquid phase ratio also flows to a portion of the two row part 83 of the second front part 53 that is not overlapped by the first row part 84 (hereinbelow, called a "notched portion 86"). Thereby, the heat of the air that passes through the notched portion 86 can be sufficiently exchanged, and condensation in the cross flow fan 21 can be prevented.

Particularly during cooling operation, because the second indoor heat exchanger unit 17 is positioned downstream of the first indoor heat exchanger unit 15 in the refrigerant flow direction, the gas phase ratio of the refrigerant that flows through the downstream portion inside the second indoor heat exchanger unit 17 tends to increase. Because the one row part 84 does not overlap the notched portion 86, the portion of the notched portion 86 where heat is exchanged is smaller than the other portion where it is not. Accordingly, when refrigerant with a high gas phase ratio flows through the notched portion 86, there is a high risk that insufficiently heat exchanged air will flow. However, with the indoor unit 2 of the present air conditioner 1, the refrigerant flows to the two row part 83 of the second front part 53 before it flows to the shorter one row part 84 of the second front part 53 as mentioned above. This prevents the refrigerant from flowing lastly to the notched portion 86 inside the indoor heat exchanger 10, and prevents insufficiently heat exchanged air from flowing.

(2)

With the indoor unit 2 of the present air conditioner 1, a structure, such as the control circuit board 94, is disposed in the space that is created by disposing the shorter one row part 84 so that it overlaps the two row part 83. Consequently, the indoor heat exchanger 10 and the structure can be compactly disposed, which makes it possible to reduce the size of the external form of the indoor unit 2.

Other Embodiments

With the embodiment mentioned above, the one row part 84, which is shorter in the transverse direction, overlaps the two row part 83, but the short direction is not limited to the transverse direction and it is possible to provide a heat exchanger unit that is shorter in another direction. For example, it is possible to provide a heat exchanger unit that is shorter in the vertical direction, or in the direction of inclination of the inclined surface of the indoor heat exchanger 10.

In addition, with the abovementioned embodiment, a shorter heat exchanger unit is provided to the second front part 53, but may be provided to another portion of the indoor heat exchanger unit 10. For example, it may be provided to the first front part 52 or the rear part 51.

In such a case as well, there is a risk that insufficiently heat exchanged air will flow, like the abovementioned embodiment, but the use of the present invention makes it possible to prevent condensation at the cross flow fan 21.

INDUSTRIAL FIELD OF APPLICATION

The present invention has an effect wherein the occurrence of condensation can be suppressed in a ventilation fan, and is useful as an indoor unit of an air conditioner.

What is claimed is:

1. An indoor unit of an air conditioner comprising:
a ventilation fan that generates a flow of air; and
a heat exchanger including
a first heat exchanger layer having a first side facing the ventilation fan, a second side opposite the first side, and top, bottom, and lateral sides connecting the first side to the second side, and
a second heat exchanger layer
layering on the first heat exchanger layer, and
having a first side facing the ventilation fan, a second side opposite the first side, and top, bottom, and lateral sides connecting the first side to the second side, and having a smaller area than that of the first heat exchanger layer,
the first side of the second heat exchanger layer being disposed to overlap and to face the second side of the first heat exchanger layer, and
during a cooling operation, a refrigerant flows to the first heat exchanger layer before flowing to the second heat exchanger layer, and the first heat exchanger layer and the second heat exchanger layer functioning as an evaporator.

2. The indoor unit as recited in claim 1, wherein
the lengths of first and second sides of the first and second heat exchanger layers extend in a direction along the rotational axis of the ventilation fan,
each of the first and second sides of the first heat exchanger layer is longer than the top, bottom, or lateral sides of the first heat exchanger layer,
each of the first and second sides of the second heat exchanger layer is longer than the top, bottom, or lateral sides of the second heat exchanger layer in the direction along the rotational axis of the ventilation fan, and the length of the first side of the second heat exchanger layer has a shape that is shorter than the length of first side of the first heat exchanger layer.

3. The indoor unit as recited in claim 1, wherein
the first heat exchanger layer is positioned on a side closer to the ventilation fan than the second heat exchanger layer.

4. The indoor unit as recited in claim 1, wherein
the second heat exchanger layer constitutes an outermost layer of the heat exchanger.

5. The indoor unit as recited in claim 4, wherein
the first heat exchanger layer constitutes an innermost layer of the heat exchanger.

6. The indoor unit as recited in claim 1, further comprising
a control circuit board that opposes a part of the first heat exchanger layer that is not overlapped by the second heat exchanger layer, and that is disposed in a space that is positioned to the side of the second heat exchanger layer.

7. The indoor unit as recited in claim 2, wherein
the first heat exchanger layer is positioned on a side closer to the ventilation fan than the second heat exchanger layer.

8. The indoor unit as recited in claim 7, wherein
the second heat exchanger layer constitutes an outermost layer of the heat exchanger.

9. The indoor unit as recited in claim 2, wherein
the second heat exchanger layer constitutes an outermost layer of the heat exchanger.

10. The indoor unit as recited in claim 9, wherein
the first heat exchanger layer constitutes an innermost layer of the heat exchanger.

11. The indoor unit as recited in claim 8, wherein
the first heat exchanger layer constitutes an innermost layer of the heat exchanger.

12. The indoor unit as recited in claim 2, further comprising
a control circuit board that opposes a part of the first heat exchanger layer that is not overlapped by the second heat exchanger layer, and that is disposed in a space that is positioned to the side of the second heat exchanger layer.

13. The indoor unit as recited in claim 3, further comprising
a control circuit board that opposes a part of the first heat exchanger layer that is not overlapped by the second heat exchanger layer, and that is disposed in a space that is positioned to the side of the second heat exchanger layer.

14. The indoor unit as recited in claim 7, further comprising
a control circuit board that opposes a part of the first heat exchanger layer that is not overlapped by the second heat exchanger layer, and that is disposed in a space that is positioned to the side of the second heat exchanger layer.

15. An indoor unit of an air conditioner comprising:
a ventilation fan that generates a flow of air; and
a heat exchanger including
a first heat exchanger layer having a first side facing the ventilation fan, a second side opposite the first, and top, bottom, and lateral sides connecting the first side to the second side, and
a second heat exchanger layer
layering on the first heat exchanger layer, and
having a first side facing the ventilation fan, a second side opposite the first, and top, bottom, and lateral sides connecting the first side to the second side,
having a smaller area than the first heat exchanger layer, and
the first side of the second heat exchanger layer being disposed to layer on and to face the second side of the first heat exchanger layer,
during a cooling operation, a refrigerant flows to the first heat exchanger layer before flowing to the second heat exchanger layer, and
the ventilation fan being configured to suck air into the indoor unit via the heat exchanger, the air being sucked into the indoor unit flowing from the second heat exchanger layer to the first heat exchanger layer.

16. The indoor unit as recited in claim 15, wherein
the lengths of first and second sides of the first and second heat exchanger layer extend in a direction along the rotational axis of the ventilation fan, each of the first and second sides of the first heat exchanger layer is longer than the top, bottom, or lateral sides of the first heat exchanger layer in the direction along the rotational axis of the ventilation fan, each of the first and second sides of the second heat exchanger layer is longer than the top, bottom, or lateral sides of the second heat exchanger layer, and the length of the first side of the second heat exchanger layer has a shape that is shorter than the length of first side of the first heat exchanger layer.

17. The indoor unit as recited in claim 15, wherein the first heat exchanger layer is positioned on a side closer to the ventilation fan than the second heat exchanger layer.

18. The indoor unit as recited in claim 15, wherein the second heat exchanger layer constitutes an outermost layer of the heat exchanger.

19. The indoor unit as recited in claim 18, wherein the first heat exchanger layer constitutes an innermost layer of the heat exchanger.

20. The indoor unit as recited in claim 15, further comprising a control circuit board that opposes a part of the first heat exchanger layer that is not overlapped by the second heat exchanger layer, and that is disposed in a space that is positioned to the side of the second heat exchanger layer.

* * * * *